US008365796B2

(12) United States Patent
Coleman et al.

(10) Patent No.: US 8,365,796 B2
(45) Date of Patent: Feb. 5, 2013

(54) METHODS, APPARATUSES, AND SYSTEMS FOR MOVABLE PARTITIONS

(75) Inventors: W. Michael Coleman, Salt Lake City, UT (US); John G. Garrett, Magna, UT (US)

(73) Assignee: Won-Door Corporation, Salt Lake City, UT (US)

( * ) Notice: Subject to any disclaimer, the term of this patent is extended or adjusted under 35 U.S.C. 154(b) by 277 days.

(21) Appl. No.: 12/758,584

(22) Filed: Apr. 12, 2010

(65) Prior Publication Data

US 2011/0247275 A1 Oct. 13, 2011

(51) Int. Cl.
*E06B 3/94* (2006.01)

(52) U.S. Cl. ..... 160/84.02; 160/188; 160/331; 49/358

(58) Field of Classification Search ..... 160/188, 160/189, 84.02, 331; 49/139, 358, 360
See application file for complete search history.

(56) References Cited

U.S. PATENT DOCUMENTS

| | | | | | |
|---|---|---|---|---|---|
| 1,817,909 | A | * | 8/1931 | Blodgett | 160/189 |
| 1,862,860 | A | * | 6/1932 | Morse | 160/188 |
| 2,703,236 | A | * | 3/1955 | Verdier | 160/188 |
| 2,879,058 | A | * | 3/1959 | Phillips | 160/188 |
| 3,012,520 | A | * | 12/1961 | Curtis | 104/235 |
| 3,166,306 | A | * | 1/1965 | Peltier | 160/188 |
| 3,240,484 | A | * | 3/1966 | Klamp | 160/189 |
| 3,261,128 | A | | 7/1966 | Slopa | |
| 3,289,741 | A | * | 12/1966 | Gossling | 160/188 |
| 3,336,968 | A | * | 8/1967 | Curtis | 160/188 |
| 3,509,934 | A | | 5/1970 | Smart | |
| 3,577,679 | A | | 5/1971 | Petterborg | |
| 3,720,254 | A | | 3/1973 | Smart | |
| 3,807,480 | A | | 4/1974 | Smart | |
| 3,909,980 | A | | 10/1975 | Courtney et al. | |

(Continued)

FOREIGN PATENT DOCUMENTS

| | | | |
|---|---|---|---|
| DE | 202005000165 | U1 | 3/2006 |
| EP | 1126125 | A2 | 8/2001 |

(Continued)

OTHER PUBLICATIONS

PCT International Search Report for corresponding PCT Application No. PCT/US2011/023004, mailed Oct. 20, 2011, 6 pages.

(Continued)

*Primary Examiner* — David Purol
(74) *Attorney, Agent, or Firm* — TraskBritt

(57) ABSTRACT

Movable partition systems include an elongated drive member with fixed, offset ends extending along a track, a partition that is automatically and manually movable along the track, the partition hanging from a trolley disposed at least partially within the track, a motor carried by the movable partition configured to drive a rotatable drive member engaged with the elongated drive member, and a clutch coupled with the motor configured to engage or disengage the rotatable drive member from the motor. Methods of moving a partition along a track include actuating a motor carried by a movable partition to drive rotation of a drive member while a clutch mechanism is engaged, and manually moving the partition along the track while the clutch mechanism is disengaged. Methods of installing a movable partition system include coupling a trolley to a rotatable drive member and placing the trolley within a channel of a track.

28 Claims, 9 Drawing Sheets

U.S. PATENT DOCUMENTS

| | | | | |
|---|---|---|---|---|
| 4,133,364 | A * | 1/1979 | Smart | 160/199 |
| 4,167,833 | A * | 9/1979 | Farina et al. | 49/199 |
| 4,957,600 | A | 9/1990 | Carlson et al. | |
| 5,253,451 | A | 10/1993 | Hormann | |
| 5,625,266 | A | 4/1997 | Stark | |
| 5,794,381 | A | 8/1998 | Rizkovsky | |
| 6,082,053 | A | 7/2000 | Bischof et al. | |
| 6,209,171 | B1 | 4/2001 | Pelletier et al. | |
| 6,233,878 | B1 | 5/2001 | Krahenbuhl et al. | |
| 6,325,134 | B1 | 12/2001 | Mullet | |
| 6,615,894 | B1 | 9/2003 | McKeon | |
| 6,662,848 | B2 | 12/2003 | Goodman et al. | |
| 7,114,753 | B2 | 10/2006 | Nodorft | |
| 7,478,663 | B2 | 1/2009 | Goodman et al. | |
| 7,481,133 | B2 | 1/2009 | Walravens et al. | |
| 7,513,293 | B2 | 4/2009 | Goodman et al. | |
| 2007/0095488 | A1 | 5/2007 | Huang | |
| 2008/0244991 | A1 | 10/2008 | Coleman et al. | |
| 2009/0188633 | A1 | 7/2009 | Goodman et al. | |

FOREIGN PATENT DOCUMENTS

| | | | |
|---|---|---|---|
| JP | 2002357055 | | 12/2002 |
| WO | 03071078 | A1 | 8/2003 |
| WO | 2005/098189 | A1 | 10/2005 |
| WO | 2005124082 | A1 | 12/2005 |
| WO | 2007105057 | A2 | 9/2007 |
| WO | 2008086519 | A2 | 7/2008 |

OTHER PUBLICATIONS

Goodman et al., U.S. Appl. No. 07/215,413, filed Jul. 5, 1988, entitled "Motorized Folding Door Lead Post Assembly and Apparatus for Monitoring Door Position", abandoned.

* cited by examiner

METHODS, APPARATUSES, AND SYSTEMS FOR MOVABLE PARTITIONS

CROSS-REFERENCES TO RELATED APPLICATION

This application is related to U.S. patent application Ser. No. 12/542,448, which was filed Aug. 17, 2009 and entitled "Methods, Apparatuses, and Systems for Driving a Movable Partition," which is incorporated herein in its entirety by this reference.

TECHNICAL FIELD

Embodiments of the invention are directed to the field of movable partitions that may be used for one or more of partitioning space, providing sound barriers, providing fire barriers, providing security barriers, or for various other purposes.

BACKGROUND

Movable partitions are utilized in numerous situations and environments for a variety of purposes. Such partitions may include, for example, foldable or collapsible doors configured to enclose or subdivide a room or other area. Often such partitions are utilized simply to subdivide a single large room within a building into multiple smaller rooms. The subdivision of a larger space may be desired, for example, to accommodate multiple groups or meetings simultaneously. Such partitions also may be used for noise control depending, for example, on the activities taking place in a given room or portion thereof.

Movable partitions may also be used to provide a security barrier, a fire barrier, or both a security barrier and a fire barrier. In such cases, the movable partition may be configured to automatically close upon the occurrence of a predetermined event, such as the actuation of an associated alarm. For example, one or more accordion or similar folding-type partitions may be used as a security barrier, a fire barrier, or both a security barrier and a fire barrier, wherein each partition includes a plurality of panels connected to one another with hinges. The hinged connection of the panels allows the partition to fold and collapse into a compact unit for purposes of storage when not deployed. The partition may be stored in a pocket formed in the wall of a building when in a retracted or folded state. When the partition is deployed to subdivide a single large room into multiple smaller rooms, secure an area during a fire, or for any other specified reason, the partition may be extended along a track, which may be an overhead track located above the movable partition on or in a header assembly, until the partition extends a desired distance across the room.

When deployed, a leading end of the movable partition, which may include or be defined by a component known as a "lead post," complementarily engages another structure, such as a wall, a post, or a lead post of another door.

Automatic extension and retraction of the movable partition may be accomplished through the use of a motor located in a pocket formed in the wall of a building in which the movable partition is stored when in a retracted or folded state. The motor, which remains fixed in place within the pocket, may be used to drive extension and retraction of the movable partition. A motor for automatically extending and retracting a movable partition may also be mounted within the movable partition itself, such that the motor travels with the movable partition as the movable partition is extended and retracted using the motor.

BRIEF SUMMARY

In some embodiments, the present invention includes movable partition systems comprising an elongated drive member with fixed ends extending along a track, a motor carried by a movable partition, a clutch coupled with and between a drive shaft of the motor and a rotatable drive member engaged with the elongated drive member with fixed ends, and a trolley coupled to the rotatable drive member and disposed within an elongated central guide member of the track. The movable partition is coupled to, and movable along, the track. The clutch may be capable of toggling between an engaged state in which the driving or stopping of the drive shaft of the motor causes the driving or stopping of the rotatable drive member and a disengaged state in which the rotatable drive member may rotate or stop independently of the driving or stopping of the drive shaft of the motor. Rotation of the drive shaft of the motor while the clutch is in the engaged position causes the rotation of the rotatable drive member, which in turn causes the partition to push or pull against the elongated drive member with fixed ends and consequently move along the track. A first end and a second end of the elongated drive member with fixed ends may be located in positions that are laterally offset from one another relative to the track.

In additional embodiments, the present invention includes automatically and manually movable partition systems that include a movable partition coupled to and movable along a track, and a motor for driving movement of the movable partition along the track. A clutch that is coupled to a drive shaft of the motor is also part of the system, as is an elongated drive member with a first fixed end and a second fixed end being laterally offset from one another relative to the track. Actuation of the motor drives movement of the movable partition along the track when the motor is actuated and the clutch is in an engaged configuration. Actuation of the motor does not drive movement of the movable partition along the track when the motor is actuated and the clutch is in a disengaged configuration. Furthermore, when the clutch is in a disengaged configuration, the movable partition is capable of being manually pushed or pulled along the track.

In additional embodiments, the present invention includes methods of moving a movable partition along a track. In accordance with such methods, a rotatable drive member is engaged with an elongated drive member with fixed, laterally offset opposite ends extending along the track, and a motor, which may be carried by the movable partition, is actuated and rotation of the rotatable drive member is driven while a clutch mechanism, coupled to the motor and the rotatable drive member, is engaged. The clutch mechanism is disengaged, and the movable partition is manually moved along the track.

In yet further embodiments, the present invention includes methods of installing a movable partition system. In accordance with such methods, a movable partition is coupled to a trolley, and a motor is mounted to the trolley. A clutch is coupled to and between a drive shaft of the motor and a rotatable drive member. The trolley is suspended from a track and disposed at least partially within a central channel of the track. The movable partition may be coupled to the trolley such that the movable partition is movable along the track. The rotatable drive member may be engaged with an elongated drive member with fixed ends, such that rotation of the rotatable drive member causes the movable partition to move along the track.

BRIEF DESCRIPTION OF THE SEVERAL VIEWS OF THE DRAWINGS

While the specification concludes with claims particularly pointing out and distinctly claiming what are regarded as embodiments of the invention, the advantages of embodiments of the invention may be more readily ascertained from the description of embodiments of the invention when read in conjunction with the accompanying drawings, in which:

DETAILED DESCRIPTION

Illustrations presented herein are not meant to be actual views of any particular movable partition system, or component of a movable partition system, but are merely idealized representations which are employed to describe embodiments of the present invention. Additionally, elements common between figures may retain the same numerical designation.

Figure 1:
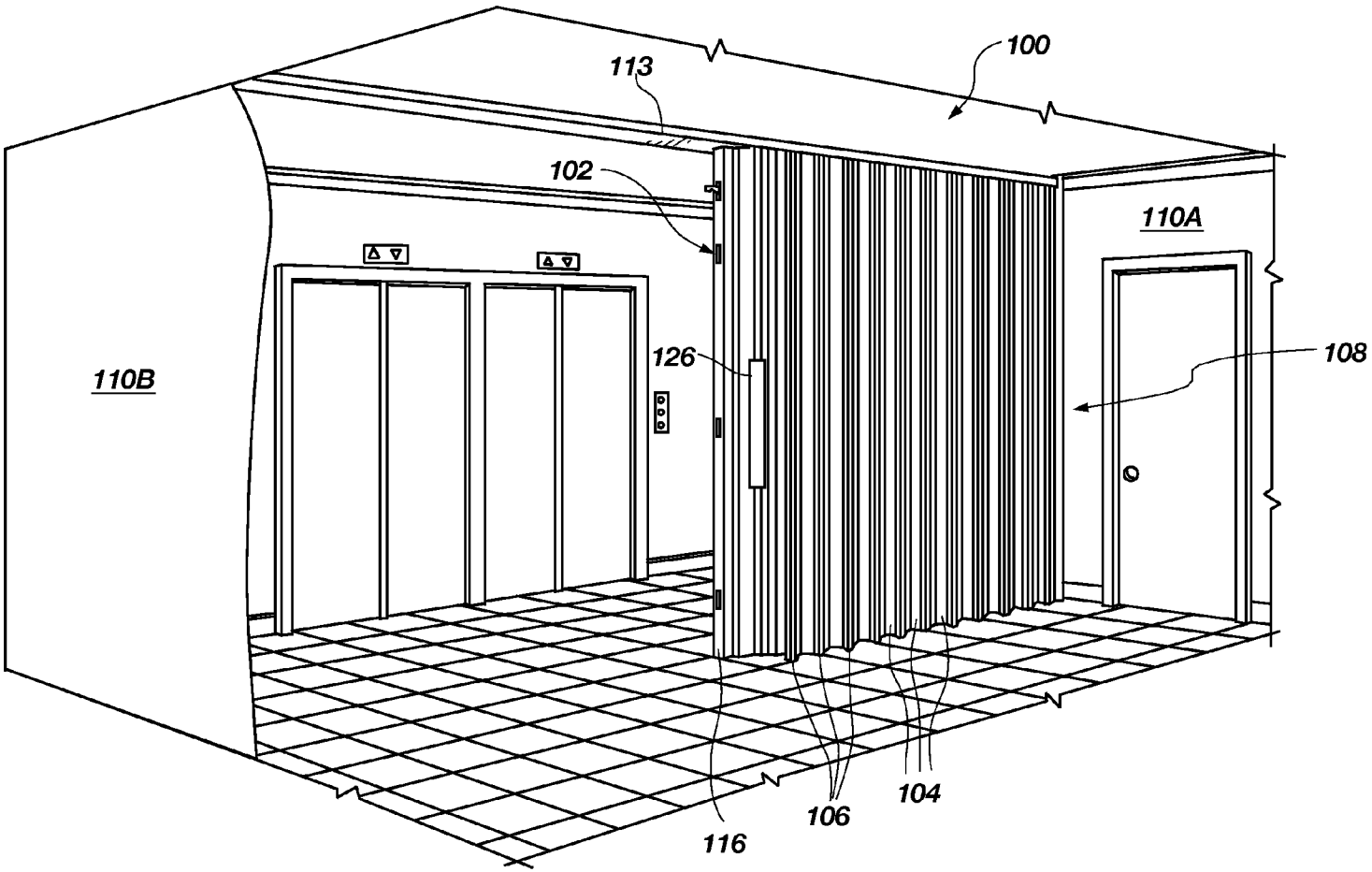
FIG. 1 is a perspective view of an embodiment of a movable partition system of the present invention.

FIG. 1 illustrates an embodiment of a movable partition system 100 of the present invention. The movable partition system 100 may be an automatic movable partition system, in that the system 100 includes a movable partition 102 that may be automatically extended, automatically retracted, or both automatically extended and automatically retracted. As discussed in further detail below, the movable partition 102 also may be manually extended, manually retracted, or both manually extended and manually retracted. In other words, the movable partition system 100 may be moved both automatically and manually, as desired. The movable partition 102 may be used for partitioning space, as a sound barrier, as a fire barrier, as a security barrier, for combinations of such purposes, or for other purposes.

The movable partition 102 may comprise, for example, an accordion-type door, as shown in FIG. 1. The movable partition 102 may be formed with a plurality of panels 104 that are connected to one another with hinges or other hinge-like members 106. The hinged connection of the panels 104 allows the panels 104 to fold, and the movable partition 102 to collapse, in accordion style, as the movable partition 102 is retracted, which allows the movable partition 102 to be compactly stored in a pocket 108 formed in a wall 110A of a building when in a retracted or folded state. In other embodiments, the movable partition 102 may comprise a sliding door, or another type of movable partition 102.

When it is desired to deploy the movable partition 102 to an extended position, the movable partition 102 is driven along a track assembly or track 113 across the space to provide an appropriate barrier. The track 113 may be referred to as an overhead track, in some embodiments.

Figure 2:
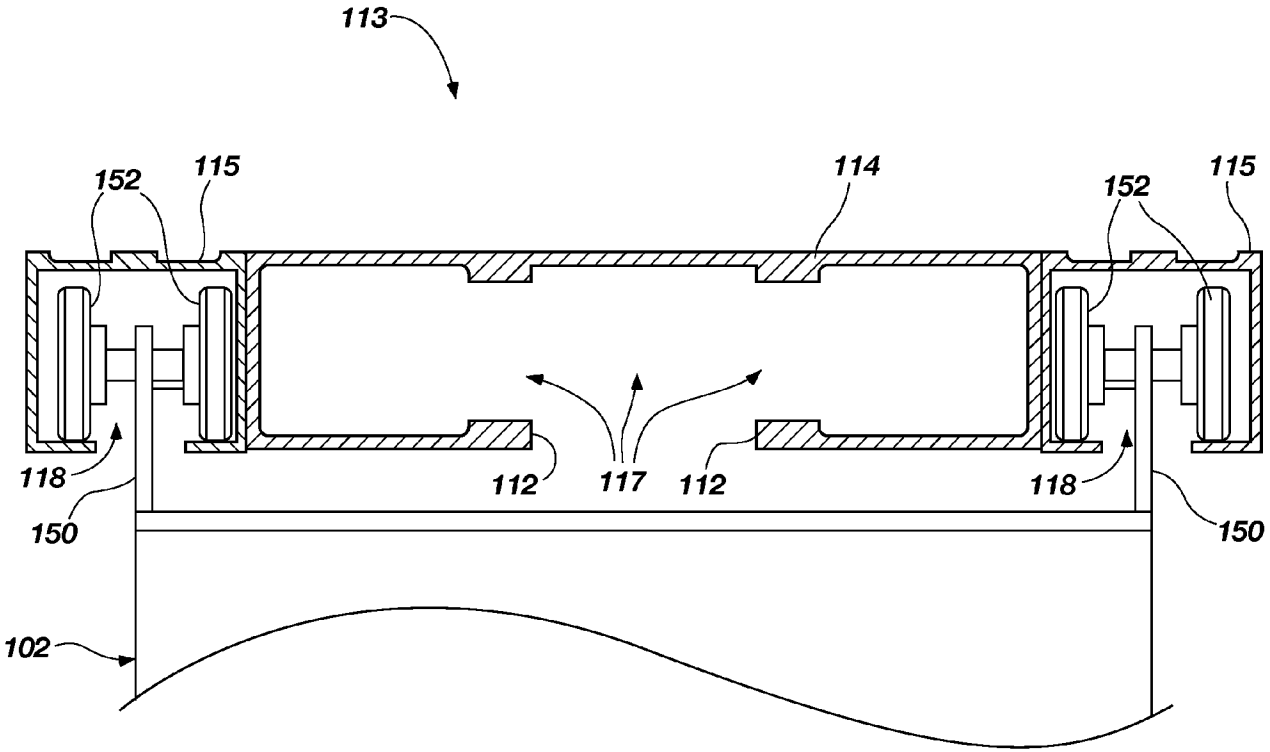
FIG. 2 is a partial cross-sectional view of a support system of the movable partition system of FIG. 1.

Referring to FIG. 2, the track assembly or track 113 may include an elongated central guide member 114, and two elongated lateral guide members 115 disposed on opposite lateral sides of the elongated central guide member 114. In some embodiments, the central guide member 114 and lateral guide members 115 may comprise separate bodies or structures that are attached to one another, or simply installed proximate one another. In additional embodiments, the central guide member 114 and lateral guide members 115 may comprise different regions of a single, unitary body or structure.

The central guide member 114 may comprise a hollow body having internal surfaces defining a channel 117 that extends longitudinally through the central guide member 114. The channel 117, also referred to as an internal channel, defined by the central guide member 114 may be used to at least partially house rollers (e.g., wheels), drive mechanism components, etc., of the movable partition system 100, as described in further detail below.

Each of the lateral guide members 115 also may comprise a hollow body having internal surfaces defining channels 118 that extend longitudinally through the lateral guide members 115, respectively. The movable partition 102 may be suspended from (i.e., hang from) partition support members 150 and move along the track 113 by the rolling of partition support rollers 152 (e.g., wheels) within and along the channels 118 that extend longitudinally through the lateral guide members 115 of the track 113. The rollers 152 may be coupled to partition support members 150 and, the movable partition 102 may be attached to and suspended from the partition support members 150.

Figure 3:
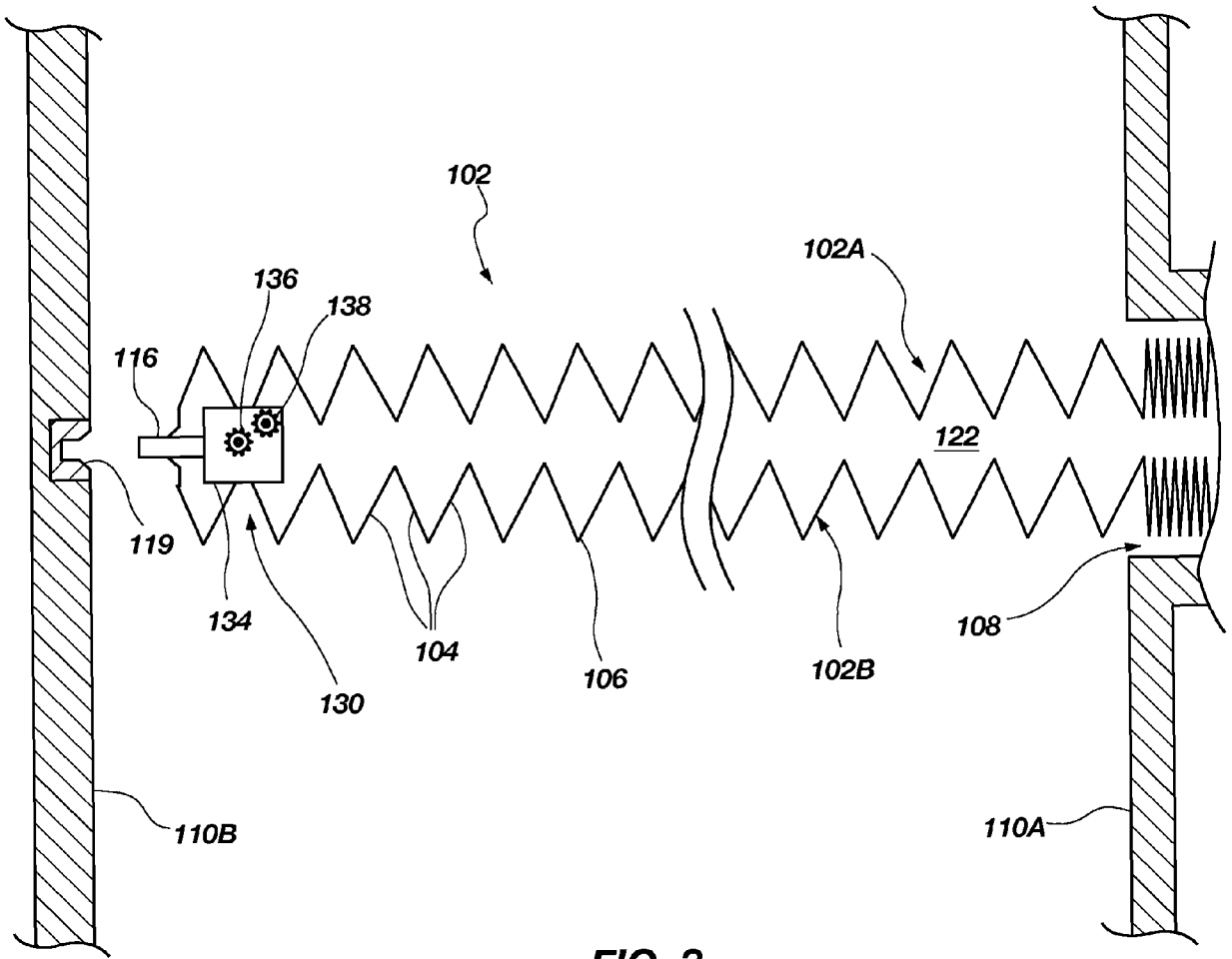
FIG. 3 is a simplified top view illustrating the movable partition and some components of a drive system of the movable partition system of FIG. 1.

Referring now to FIG. 3, a leading end of the movable partition 102, shown as a male lead post 116, matingly (i.e., complementarily) engages with a jamb or door post 119 that may be formed in another wall 110B of a building, when the movable partition 102 is in a deployed or an extended state. In other embodiments, the male lead post 116 may also matingly engage with a female lead post (not shown) of another movable partition (not shown) also suspended from the track 113. Such an additional movable partition with the female lead post (not shown) may also be configured to move automatically and/or manually.

An accordion-type movable partition 102 may include a first sheet 102A of panels 104 and a second sheet 102B of panels 104 that is laterally spaced from the first sheet 102A of panels 104. The leading ends of the first sheet 102A and the second sheet 102B may be attached at or near the lead post 116. Such a configuration may be used as a fire door wherein one sheet 102A acts as a primary fire and smoke barrier, a space 122 between the first sheet 102A and the second sheet 102B acts as an insulator or a buffer zone, and the second sheet 102B acts as a secondary fire and smoke barrier. Such a configuration may also be useful in providing an acoustical barrier when the movable partition 102 is used to subdivide a larger space into multiple rooms.

Figure 4A:
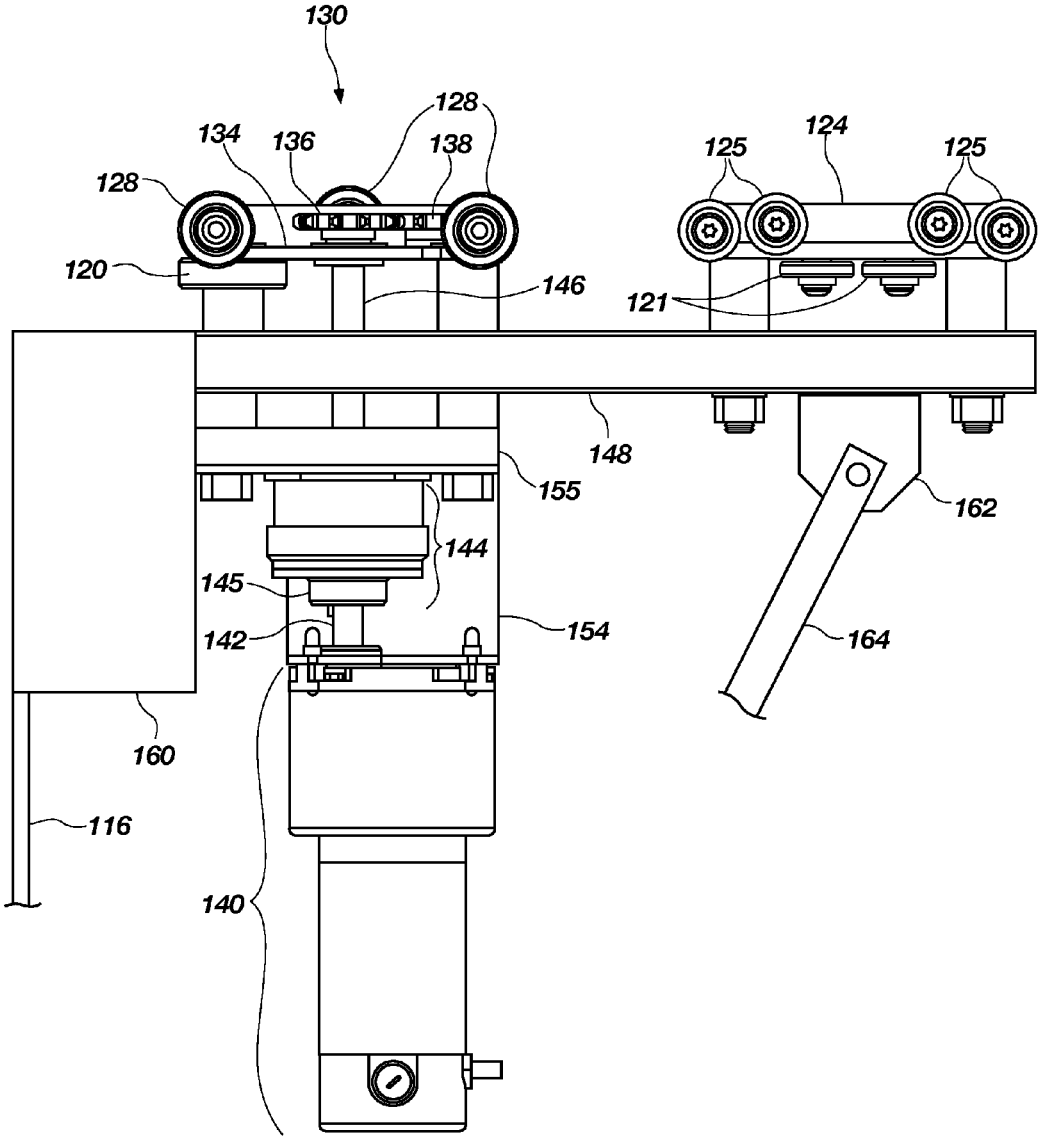
FIGS. 4A and 4B are a side view and a perspective view illustrating components of the drive system and the support system of the movable partition system of FIG. 1.
Figure 4B:
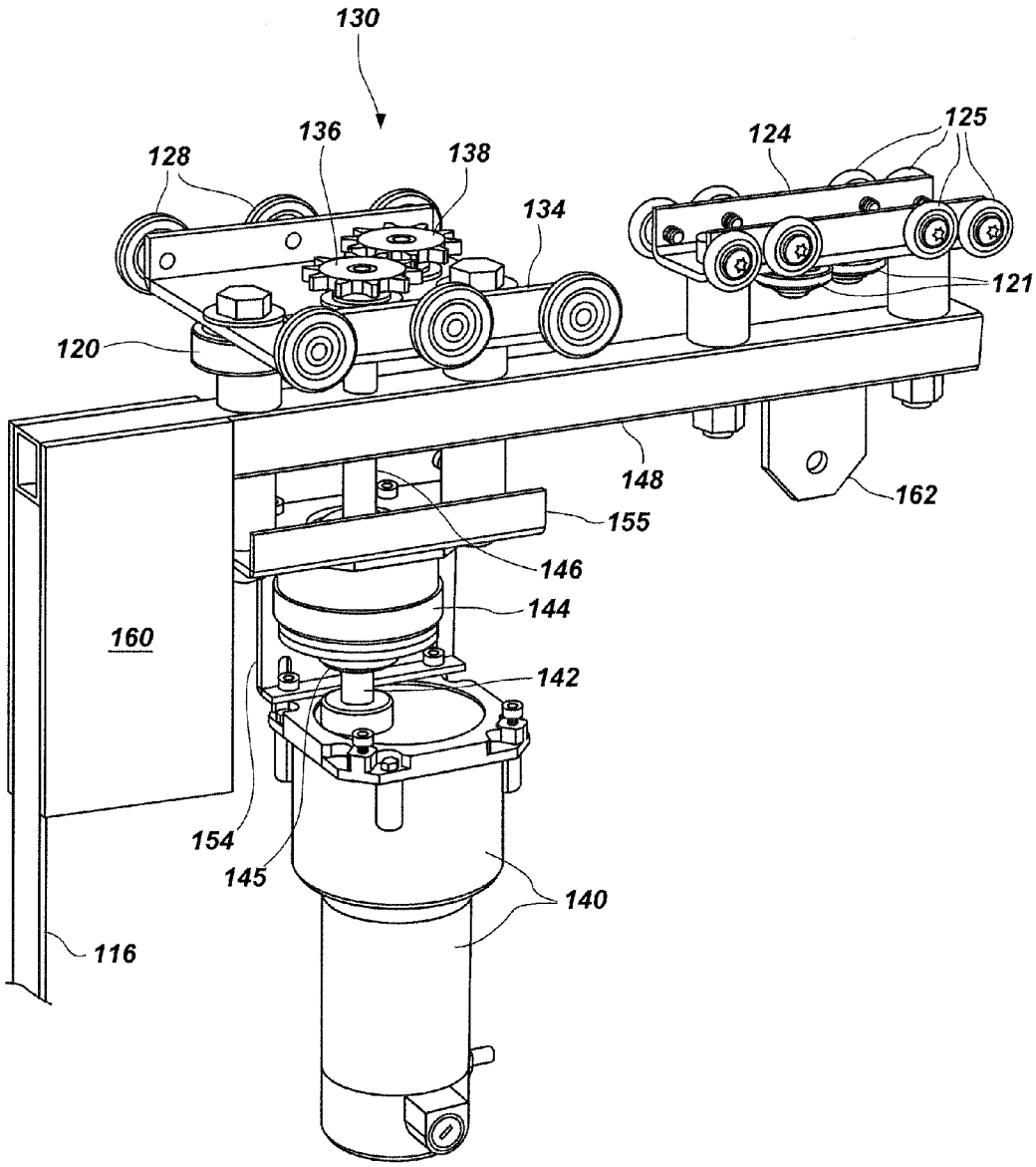

Referring to FIGS. 4A and 4B in conjunction with FIG. 3, an automatic drive system 130 may be configured to automatically open, automatically close, or to both automatically open and automatically close the movable partition 102 upon actuation thereof. The drive system 130 may include a drive trolley 134, which may be disposed at least partially within the channel 117 extending longitudinally through the elongated central guide member 114 (see FIG. 2), near the leading end of the movable partition 102. The drive system 130 may also include a motor 140 and a clutch 144, which may be located in the space 122 between the first sheet 102A and the second sheet 102B. The motor 140 and the clutch 144 may be operatively connected, such that a drive shaft 142 of motor 140 drives the rotation of a drive shaft 146 or output of clutch 144 when the clutch 144 is in an engaged state. The drive system 130 may further include a rotatable drive member 136 that is operatively connected to the drive shaft 146 of the clutch 144, such that the motor 140 may be used to drive rotation of the rotatable drive member 136 when the clutch 144 is engaged. In some embodiments, the rotatable drive member 136 may be carried by the drive trolley 134. The motor 140, clutch 144, drive trolley 134, and rotatable drive member 136 may be supported by a drive mechanism support member 148, which may be attached to the movable partition 102 at or near the leading end of the movable partition 102, such that the drive system 130 may drive movement of the movable partition 102 along the track 113 (FIG. 1). In other words, the motor 140 and the clutch 144 may be carried by the movable partition 102.

Optionally, an additional support trolley 124 also may be coupled to the drive mechanism support member 148 for providing additional structural support to the drive system 130. The additional support trolley 124 may comprise support trolley rollers 125 (e.g., wheels), and may be configured to roll along the track 113 at least partially within the channel 117 extending longitudinally through the elongated central guide member 114 (FIG. 2).

As can be seen in FIGS. 4A and 4B, the drive mechanism support member 148 may be attached near or at the top of the lead post 116. The lead post 116 may further be attached to a lead post attachment bracket 160. A diagonal bar attachment bracket 162 may be attached to the drive mechanism support member 148. A diagonal bar 164 may be attached to the diagonal bar attachment bracket 162 and to the lead post 116 (attachment to lead post 116 not shown). Thus, the lead post 116, drive mechanism support member 148, and diagonal bar 164 may form a triangular frame that provides structural support to the drive system 130 and couples the drive system 130 to the movable partition 102 (FIG. 1). Furthermore, some embodiments may include a clutch support member 155 and at least one motor support member 154, attached to the drive mechanism support member 148, to which the clutch 144 and motor 140 may be fastened, respectively. The drive mechanism support member 148 may be carried by the drive trolley 134. In other words, the motor 140 and the clutch 144 may hang from the drive trolley 134. In other embodiments, the clutch 144 and the motor 140 may be attached directly to the drive mechanism support member 148, lead post 116, lead post attachment bracket 160, drive trolley 134, and/or any other support member coupled with the movable partition 102.

Figure 5:
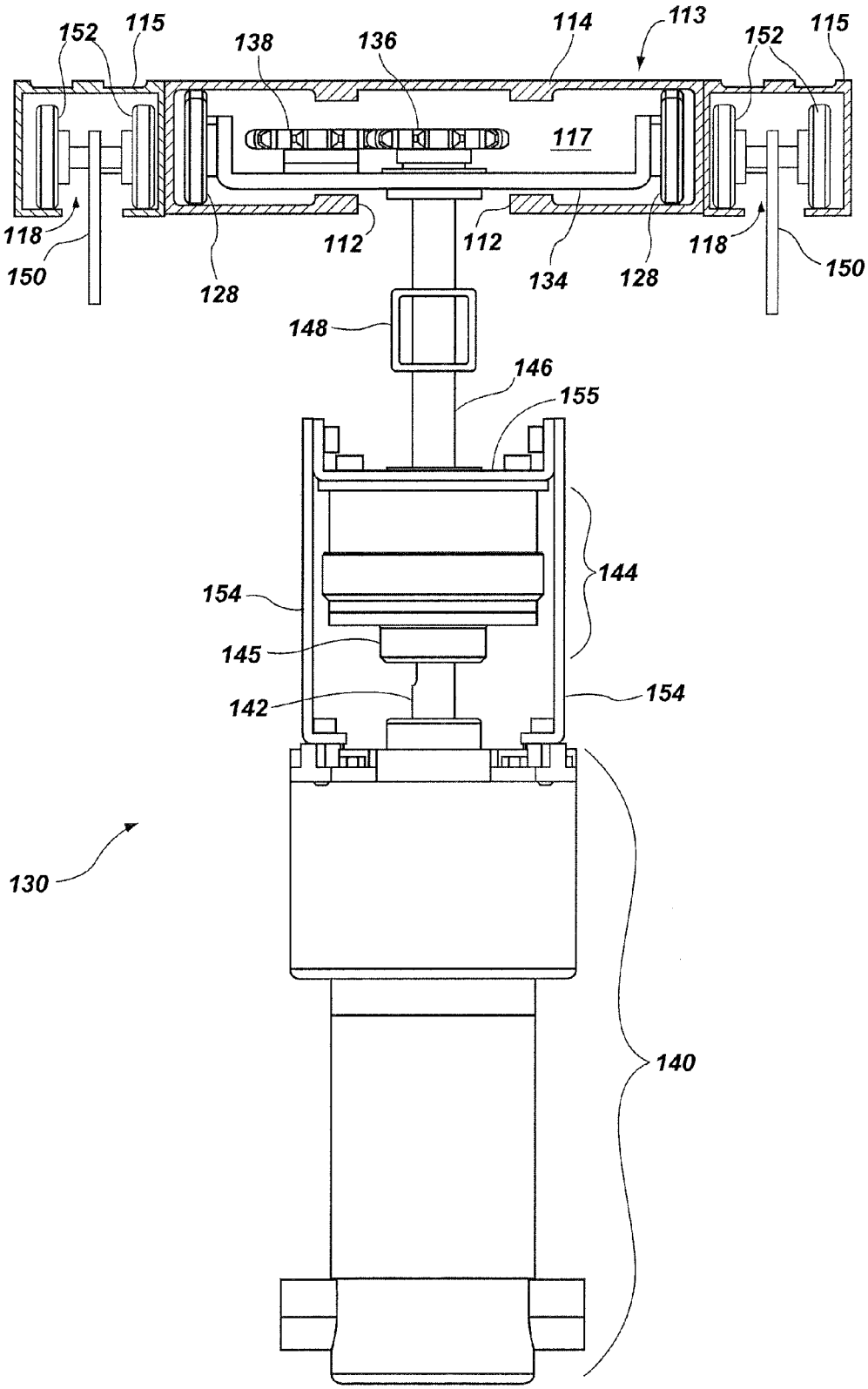
FIG. 5 is a partial cross-sectional view like that of FIG. 2 showing various components of the drive system of the movable partition system of FIG. 1.
Figure 6:
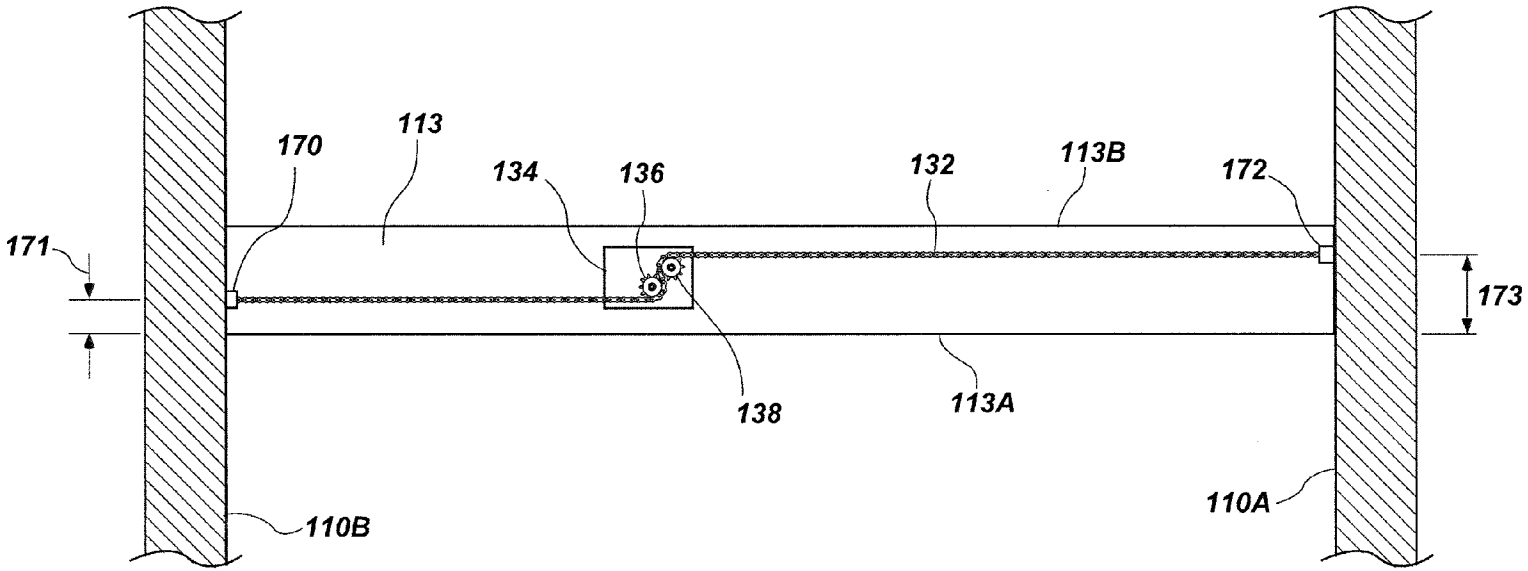
FIG. 6 is a simplified top view similar to FIG. 3 illustrating components of the drive system of the movable partition system of FIG. 1.
Figure 7:
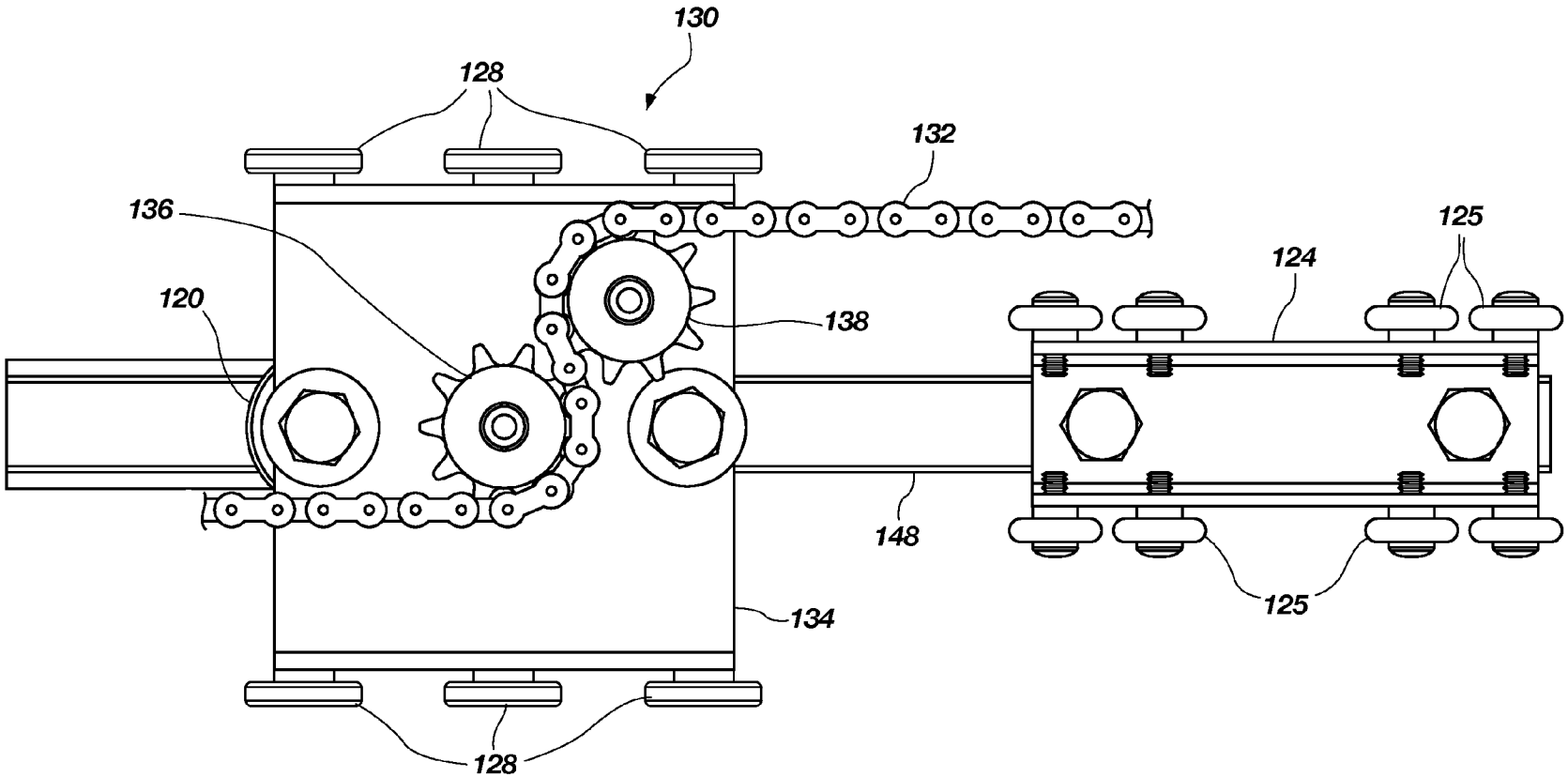
FIG. 7 is a top plan view showing in detail certain components of the drive system of the movable partition system of FIG. 1.

As discussed in further detail below, the rotatable drive member 136 shown in FIGS. 3, 4A, and 4B may be positioned within the channel 117 defined by the central guide member 114 (as shown in FIG. 5), and may be configured to interact with an elongated drive member 132 with fixed ends such as, for example, a chain (as shown in FIGS. 6 and 7), which also may be positioned within the channel 117. In other embodiments, the rotatable drive member 136 and the elongated drive member 132 may be located at least partially outside the channel 117. The elongated drive member 132 may be fixed at each end at or proximate the ends of the track 113, as described in further detail below. The rotatable drive member 136 may be engaged with the elongated drive member 132, such that rotation of the rotatable drive member 136 drives movement of the movable partition 102 along the elongated drive member 132 and along the track 113.

Some embodiments may also include a rotatable idler 138, also engaged with the elongated drive member 132 and coupled to the drive trolley 134, as shown in FIGS. 4A and 4B. The rotatable idler 138 may rotate freely as the movable partition 102 is moved along the track 113 either automatically or manually. The rotatable idler 138 may be positioned to ensure that the elongated drive member 132 remains engaged with the rotatable drive member 136 under a desirable tension. The elongated drive member 132 may extend at least partially around the rotatable drive member 136, between the rotatable drive member 136 and the rotatable idler 138, and at least partially around the rotatable idler 138, as shown in FIGS. 6 and 7. In additional embodiments, however, the movable partition system 100 may not include any rotatable idler 138, or may include more than one rotatable idler 138.

Referring again to FIGS. 4A and 4B, an alignment member 120 may be coupled to the drive trolley 134 and configured to limit the movement of the drive trolley 134 and the movable partition 102 in a lateral direction relative to the length of the track 113. The alignment member 120 may comprise a roller (e.g., a wheel). In other embodiments, the alignment member 120 may be or include a post. The alignment member 120 may be located on the drive trolley 134 so as to abut against and roll along surfaces 112 of the elongated central guide member 114 along a slot leading to the channel 117 that extends longitudinally through the central guide member 114, as can be seen in FIGS. 2 and 5. In other words, when the movable partition 102 is moved along the track 113, the alignment member 120 may abut against and roll along one of the opposing channel surfaces 112 if the movable partition 102 is urged to one lateral side or the other, thus keeping the drive trolley 134 and movable partition 102 generally aligned with the center of the track 113. In other embodiments, one or more support trolley alignment members 121 may be provided on a support trolley 124 in a similar fashion, as shown in FIGS. 4A and 4B.

As can be seen in FIG. 5 in conjunction with FIGS. 4A and 4B, the drive system 130 may be suspended from the track 113 by the drive trolley 134 and the support trolley 124. Furthermore, the drive system 130 may be moved along the track 113 by the rolling action of drive trolley rollers 128 (e.g., wheels) and the support trolley rollers 125 within the channel 117 of the central guide member 114. The support trolley 124 and support trolley rollers 125 may be disposed fully or partially within the channel 117 in the central guide member 114 of the track 113. The drive trolley 134 and drive trolley rollers 128 may also be disposed fully or partially within the channel 117. In this configuration, the drive trolley 134 may not extend laterally beyond the sheets 102A, 102B of panels 104, which may improve the integrity of the barrier provided by the movable partition 102 (FIG. 3) relative to previously known partition systems that include a motor carried on a trolley within the movable partition. Furthermore, by configuring the drive trolley 134 to ride within the channel 117 within the central guide member 114 (as opposed to within the channels 118 within the lateral guide members 115, for example), the drive trolley 134 may be smaller compared to previously known trolleys.

The rotatable drive member 136 may also be disposed within the channel 117 of the central guide member 114 of the track 113. An elongated drive member 132 (shown in FIGS. 6 and 7), which, in some embodiments, may comprise a chain or a belt having fixed ends, may also be disposed within the channel 117 of the central guide member 114 so as to allow the rotatable drive member 136 to engage the elongated drive member 132.

In this configuration, when the motor 140 is actuated and the clutch 144 is engaged, the rotatable drive member 136 is rotated and, depending on the direction of rotation, the movable partition 102 is extended or retracted along the track 113 (FIG. 1). The automatic movable partition system 100 (FIG. 1) may further include various sensors, switches, and controls to assist in the control of the drive system 130 of the movable partition 102.

As can be seen in FIGS. 4A, 4B, and 5, the drive system 130 may include a Motor 140 that controls and drives rotation of the rotatable drive member 136, shown in the figures as a sprocket. As one non-limiting example, the motor 140 may include a 12-volt DC motor, like those commercially available from Bodine Electric Company of Chicago, Ill. Of course, other types of motors may be employed in additional embodiments of the present invention.

As shown in FIGS. 4A, 4B, and 5, the drive system 130 may also include a clutch 144 which may be in an engaged state or a disengaged state. By way of example and not limitation, the drive shaft 142 of the motor 140 may serve as the input to the clutch 144. The drive shaft 142 of the motor 140 may be attached to a hub 145 of the clutch 144. The output of the clutch 144, shown here as the drive shaft 146 of the clutch 144, may be driven by the motor 140 when the clutch 144 is in an engaged state. The drive shaft 146 of the clutch 144 may not be driven by the motor 140 when the clutch 144 is in a disengaged state. In such a disengaged state, the drive shaft 146 and rotatable drive member 136 may rotate freely, without the effects of the resistance of the motor 140. In other words, the movable partition system 100 may be in a disengaged state. In some embodiments, when the movable partition system 100 is in a disengaged state, the movable partition 102 may be moved along the track 113 manually, without any resistance to such movement that might be provided by the motor 140 if movement of the movable partition 102 caused rotation of the drive shaft 146 of the motor 140. Furthermore, the clutch 144 may be in a partially engaged state, in which some of the rotation of the drive shaft 142 of the motor 140 is transferred into rotation of the drive shaft 146 of the clutch 144, but not all of the rotation is transferred. This engagement, disengagement, and partial engagement is accomplished by the normal operation of the clutch 144, as is well known in the art.

As a non-limiting example, the clutch 144 may include a 12-volt DC electromagnetic clutch, such as, for example, the KEB CombiNorm Clutch that is commercially available from KEB America, Inc. of Shakopee, Minn. Of course, other types of clutches may be used in additional embodiments of the invention. Furthermore, other mechanisms may be used for engaging and disengaging the drive shaft 142 of the motor 140 as it relates to the rotatable drive member 136.

It is noted that, while the embodiment shown and described with respect to FIGS. 1 through 5 above is directed to a single accordion-type movable partition 102, other movable partitions may be used. For example, a two-door, or bi-part door, system may be utilized wherein two similarly configured doors extend across a space and join together to form an appropriate barrier.

Referring to FIGS. 6 and 7, the rotatable drive member 136 (e.g., sprocket or gear) may be engaged with the elongated drive member 132 (e.g., chain or belt). The rotation of the rotatable drive member 136 causes the partition 102 to be pulled or pushed along the track 113 of the automatic movable partition system 100 into a desired position when the clutch 144 is engaged. In other words, the movable partition system 100 may be in an engaged configuration. FIG. 6 shows the elongated drive member 132 as a chain that is complementary to the teeth of a sprocket that serves as the rotatable drive member 136. The elongated drive member 132 may be fixed at or near both longitudinal ends of the track 113, such as in pocket 108 in wall 110A and at the jamb or door post 119 in wall 110B. A first end of the elongated drive member 132 may be fixed to a first elongated drive member attachment 170, which may be referred to as a first chain block. A second end of the elongated drive member 132 may be fixed to a second elongated drive member attachment 172, which may be referred to as a second chain block. The first elongated drive member attachment 170 may be rigidly fastened at or near wall 110B, and the second elongated drive member attachment 172 may be rigidly fastened at or near wall 110A. Thus, the longitudinal ends of elongated drive member 132 may be fixed to the walls 110A and 110B at or near the longitudinal ends of track assembly or track 113. In this configuration, the elongated drive member 132 is linear, and does not form or include a loop, as would a looped chain or a looped belt.

Figure 8:
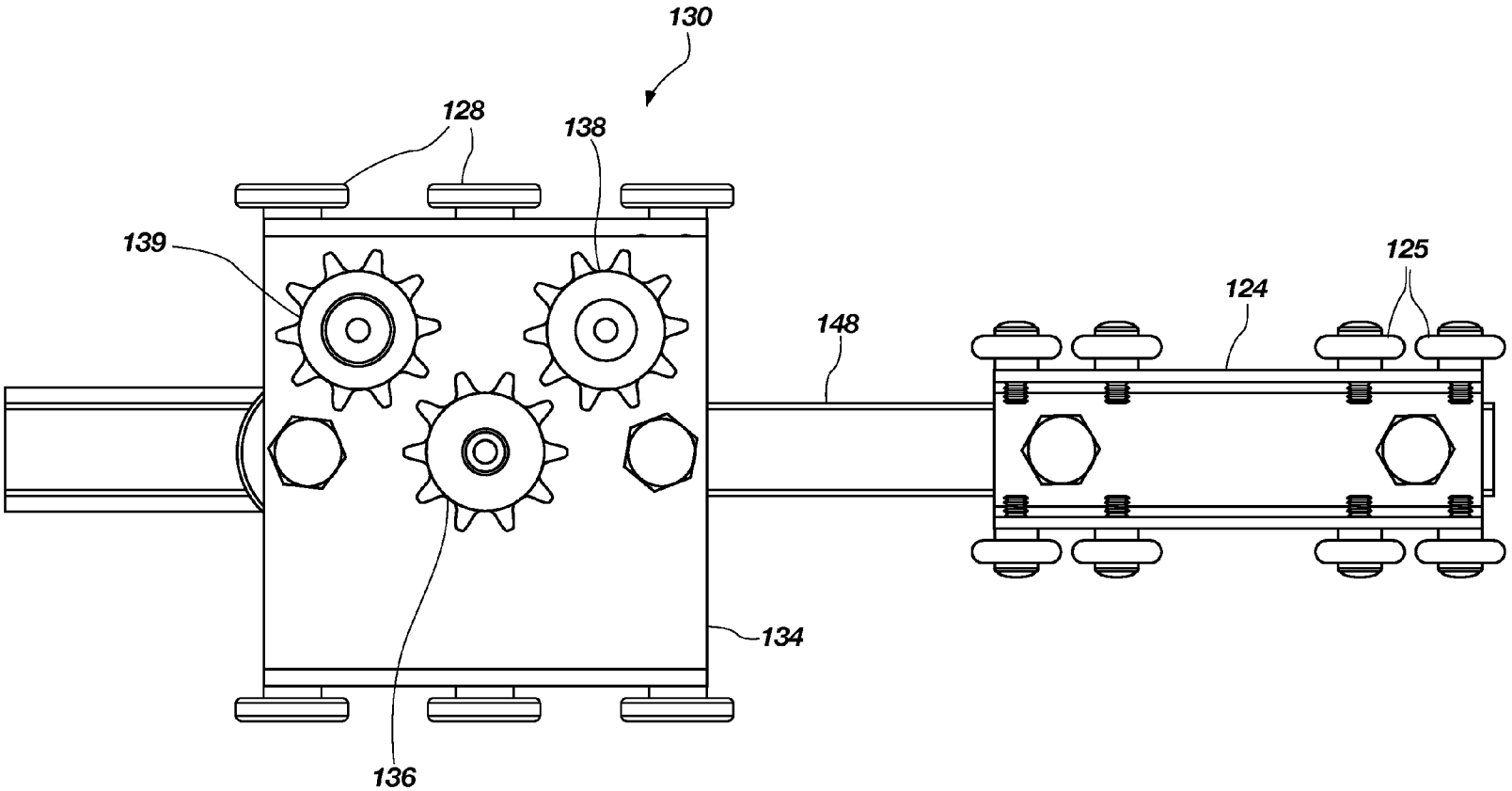
FIG. 8 is a top view similar to FIG. 7 illustrating another embodiment of the drive system of the movable partition system of FIG. 1.

In some embodiments, the ends of the elongated drive member 132 may be fixed to the walls 110A and 110B in an offset manner. In other words, a first distance 171 from the first elongated drive member attachment 170 to a first lateral side 113A of the track 113 may be more or less than a second distance 173 from the second elongated drive member attachment 172 to the second lateral side 113B of the track 113, as shown in FIG. 6. However, in other embodiments, the first distance 171 and the second distance 173 may be substantially the same, and the elongated drive member 132 may be substantially aligned with the track 113 along its entire length. In such embodiments, the drive system 130 may include a second rotatable idler 139, as shown in FIG. 8, so the elongated drive member 132 may engage with and extend partially around the first rotatable idler 138, engage with and extend partially around the rotatable drive member 136, and engage with and extend partially around the second rotatable idler 139. Thus, the elongated drive member 132 may be substantially aligned with the track 113 along its length while still remaining engaged with rotatable drive member 136.

In additional embodiments, the elongated drive member 132 may comprise a belt, cable, or rope and the rotatable drive member 136 may comprise a pulley, wheel, or cog instead of a chain and sprocket as shown. Any of these configurations or their equivalents may be used to drive the movable partition 102 along the track 113 in accordance with embodiments of the present invention.

Control of the drive system 130 and, hence, movement of the movable partition 102 may be accomplished, in some embodiments, by the use of sensors and controls. Referring again to FIGS. 4A and 4B in conjunction with FIG. 1, the movable partition 102, when used as a fire door, for example, may include a switch or actuator 126, commonly referred to as "panic hardware." The movable partition 102 may be configured to automatically close upon actuation of a fire alarm. Actuation of the panic hardware 126, however, may allow a person located on one side of the movable partition 102 to cause the door to be opened if it is closed, or to stop while it is closing, allowing egress through the barrier formed by the door as needed. Allowance of access upon actuation of the panic hardware 126 may occur by automatically powering off and disengaging the clutch 144, which may allow the rotatable drive member 136 to rotate freely, as described above.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention includes all modifications, equivalents, and alternatives falling within the spirit and scope of the invention as defined by the following appended claims.

What is claimed is:

1. A movable partition system comprising:

a movable partition coupled to and movable along a track extending longitudinally between a first end and a second end, the track comprising an elongated central guide member and two elongated lateral guide members disposed on opposite lateral sides of the elongated central guide member;

a motor carried by the movable partition;

an elongated drive member extending along the track and at least partially within the central guide member, the elongated drive member comprising:

a first fixed end proximate the first end of the track; and a second fixed end proximate the second end of the track;

a rotatable drive member engaged with the elongated drive member;

a clutch coupled with and between each of a drive shaft of the motor and the rotatable drive member; and at least one trolley comprising rollers disposed at least partially within the elongated central guide member and coupled to the motor.

2. The movable partition system of claim 1, wherein the clutch comprises:

a clutch drive shaft rotationally fixed relative to the rotatable drive member; and a hub coupled to the drive shaft of the motor.

3. The movable partition system of claim 1, wherein the rotatable drive member comprises one of a sprocket and a gear and the elongated drive member comprises one of a chain and a belt having features complementary to, and configured to engage with, features of the rotatable drive member.

4. The movable partition system of claim 1, wherein the elongated drive member is at least substantially disposed within an internal channel extending through the elongated central guide member.

5. The movable partition system of claim 1, further comprising at least one alignment member coupled with the movable partition and configured to hinder movement of at least a portion of the movable partition in a lateral direction relative to a length of the track.

6. The movable partition system of claim 5, wherein the at least one alignment member comprises a roller located and configured to roll along at least one surface of the central elongated guide member as the movable partition moves along the track.

7. The movable partition system of claim 4, wherein the first fixed end of the elongated drive member is located closer to one lateral side of the track than is the second fixed end of the elongated drive member, the first fixed end and the second fixed end of the elongated drive member being laterally offset from one another relative to the track.

8. The movable partition system of claim 1, wherein at least a substantial portion of the elongated drive member on one side of the rotatable drive member is not collinear with at least a substantial portion of the elongated drive member on an opposite side of the rotatable drive member.

9. The movable partition system of claim 1, further comprising a rotatable idler coupled to the at least one trolley and engaged with the elongated drive member.

10. The movable partition system of claim 1, further comprising at least one roller coupled with the at least one trolley and located and configured to hinder movement of the at least one trolley in a lateral direction relative to a length of the track.

11. The movable partition system of claim 9, wherein the elongated drive member extends at least partially around the rotatable drive member and at least partially around the rotatable idler.

12. The movable partition system of claim 1, wherein the motor and the clutch hang from the at least one trolley.

13. The movable partition system of claim 1, wherein the at least one trolley comprises at least two trolleys, each of the at least two trolleys suspended from the track by at least one roller at least partially disposed within the internal channel extending through the elongated central guide member.

14. The movable partition system of claim 1, wherein the movable partition comprises at least one accordion folding panel.

15. The movable partition system of claim 14, wherein the at least one accordion folding panel comprises at least two accordion folding panels, the motor being disposed between the at least two accordion folding panels.

16. An automatically and manually movable partition system, comprising:

a movable partition coupled to and movable along a track;

a motor carried by the movable partition and configured to drive movement of the movable partition along the track;

a clutch coupled to a drive shaft of the motor; and an elongated drive member extending along the track and comprising:

a first fixed end proximate the first end of the track; and a second fixed end proximate the second end of the track;

wherein actuation of the motor drives movement of the movable partition along the track when the clutch is in an engaged configuration, and actuation of the motor does not drive movement of the movable partition along the track when the clutch is in a disengaged configuration, the movable partition being manually movable along the track when the clutch is in a disengaged configuration by manually pushing or pulling the movable partition along the track.

17. The automatically and manually movable partition system of claim 16, further comprising a rotatable drive member coupled to the clutch, the rotatable drive member engaged with the elongated drive member, wherein actuation of the motor when the clutch is in an engaged configuration causes rotation of the rotatable drive member and movement of the movable partition along the track.

18. The automatically and manually movable partition system of claim 17, wherein the movable partition comprises a first accordion folding panel and a second accordion folding panel, and the motor and the clutch are disposed between the first accordion folding panel and the second accordion folding panel.

19. The automatically and manually movable partition system of claim 17, wherein the track comprises an elongated guide member having an internal channel extending longitudinally through the elongated guide member, and the elongated drive member is at least substantially disposed within the internal channel extending longitudinally through the elongated guide member.

20. The automatically and manually movable partition system of claim 19, further comprising a trolley coupled to the motor, the trolley comprising at least one roller disposed within the internal channel extending longitudinally through the elongated guide member.

21. A method of moving a movable partition along a track, the method comprising:

engaging a rotatable drive member with an elongated drive member extending along a track and having a first fixed longitudinal end and a second, opposite fixed longitudinal end laterally offset from the first fixed longitudinal end relative to the track;

engaging a clutch mechanism coupled to and between the rotatable drive member and a motor carried by the movable partition;

actuating the motor and driving rotation of the rotatable drive member to automatically move the movable partition along the track while the clutch mechanism is engaged;

disengaging the clutch mechanism; and manually pushing or pulling the movable partition along the track while the clutch mechanism is disengaged.

22. The method of claim 21, further comprising:

fixing the first longitudinal end of the elongated drive member at or near a first longitudinal end of the track; and fixing the second longitudinal end of the elongated drive member at or near a second longitudinal end of the track.

23. The method of claim 21, wherein engaging a rotatable drive member with an elongated drive member comprises engaging teeth of a sprocket with a chain.

24. A method of installing a movable partition system, comprising:

fixing each end of an elongated drive member relative to an overhead track and extending the elongated drive member longitudinally through a channel extending longitudinally within a central guide member of the overhead track, the overhead track comprising two lateral guide members disposed on opposite lateral sides of the central guide member;

mounting a motor to a trolley;

coupling a clutch mechanism to and between a drive shaft of the motor and a rotatable drive member;

engaging the rotatable drive member with the elongated drive member;

suspending the trolley from the overhead track using at least one roller coupled to the trolley and disposed within the channel extending longitudinally within the central guide member of the overhead track; and coupling a movable partition to the trolley such that the movable partition is movable along the track.

25. The method of claim 24, further comprising:

engaging the clutch mechanism such that rotation of the drive shaft of the motor causes rotation of the rotatable drive member; and disengaging the clutch mechanism such that rotation of the drive shaft of the motor does not cause rotation of the rotatable drive member and such that the movable partition may be moved along the overhead track by manually pushing or pulling the movable partition along the overhead track.

26. The method of claim 24, further comprising attaching at least one alignment member to the movable partition and limiting movement of at least a portion of the movable partition in a direction lateral relative to the overhead track using the at least one alignment member.

27. The method of claim 24, wherein fixing each end of an elongated drive member relative to an overhead track comprises:

fixing a first end of the elongated drive member at a first location disposed a first distance from a first lateral side of the overhead track; and fixing a second end of the elongated drive member at a second location disposed a second distance from the first lateral side of the overhead track, the second distance differing from the first distance.

28. The movable partition system of claim 1, wherein the rotatable drive member is disposed within the elongated central guide member and between laterally opposite rollers of the at least one trolley and wherein the elongated drive member is disposed within the elongated central guide member and extends longitudinally between laterally opposite rollers of the at least one trolley.

* * * * *